US005617698A

United States Patent [19]

Guilmette

[11] Patent Number: 5,617,698

[45] Date of Patent: Apr. 8, 1997

[54] CLAMP FOR HOLDING WALL PANEL AGAINST ADHESIVE

[75] Inventor: Bruce T. Guilmette, Ortonville, Mich.

[73] Assignee: Foamseal, Inc., Oxford, Mich.

[21] Appl. No.: 380,391

[22] Filed: Jan. 30, 1995

[51] Int. Cl.[6] ..... E04D 15/00

[52] U.S. Cl. ..... 52/749.1; 248/363; 248/205.6

[58] Field of Search ..... 52/249.1, 127.1, 52/127.2, 514; 248/362, 363, 205.5, 205.6, 205.7, 206.1

[56] References Cited

U.S. PATENT DOCUMENTS

| | | | |
|---|---|---|---|
| 3,047,165 | 7/1962 | Hutchinson | 214/1 |
| 3,065,550 | 11/1962 | Pattiani | 33/194 |
| 3,375,312 | 3/1968 | Hart | 264/272 |
| 3,593,983 | 7/1971 | Csenyi | 248/362 X |
| 3,787,039 | 1/1974 | Zeichman | 248/363 X |
| 3,787,544 | 1/1974 | Barnette | 264/69 |
| 3,856,291 | 12/1974 | Nilsen | 269/22 |
| 4,065,540 | 12/1977 | Okami | 264/278 |
| 4,083,156 | 4/1978 | Tye | 52/127 |
| 4,124,424 | 11/1978 | Preston | 156/155 |
| 4,148,471 | 4/1979 | Werner | 269/321 |
| 4,242,292 | 12/1980 | Mercer et al. | 264/16 |
| 4,547,255 | 10/1985 | Yow | 156/580 |
| 4,567,821 | 2/1986 | McDonald | 100/100 |
| 4,824,004 | 4/1989 | Hanson | 227/152 |
| 4,927,479 | 5/1990 | Bock . | |
| 5,053,179 | 10/1991 | Masui et al. | 264/257 |
| 5,121,540 | 6/1992 | Dykstra | 29/772 |
| 5,234,204 | 8/1993 | Hunt | 269/41 |
| 5,500,503 | 3/1996 | Pernicka et al. | 52/788 X |

*Primary Examiner*—Creighton Smith
*Attorney, Agent, or Firm*—Howard & Howard

[57] ABSTRACT

A clamp holds a wall panel against an adhesive bead on a wall frame as the adhesive bead cures. The clamps are automatically actuated to first secure the clamp to the structure adjacent the panel, and then hold the panel against the adhesive bead as the bead cures. In a first embodiment, the clamp is placed across the abutting edges of two adjacent panels, and a vacuum is drawn on both of the panels to draw edges of the panels against a reference surface. The reference surface insures that the edges of the panels an in abutting aligned relationships as the adhesive cures. In other embodiments of this invention the clamp may include a pusher member that receives a fluid pressure to drive the pusher member against the panel and hold the panel as the adhesive cures. With these embodiments there is also securement structure for holding the clamp against the panel. The securement members may be threaded screws driven by motors into the floor and ceiling. The securement structure may include separate cylinders which receive hydraulic pressure to hold securement members against structure such as the ceiling and floor, or may include suction cups. In a method according to this invention the clamp is initially placed adjacent a panel, and the securement structure is actuated to hold the clamp at a desired location. The clamp is then actuated to hold the panel against the first surface of the clamp as the adhesive curves. The first surface ensures that the panel is in a location where it will be in contact with the adhesive bead as the adhesive cures.

25 Claims, 4 Drawing Sheets

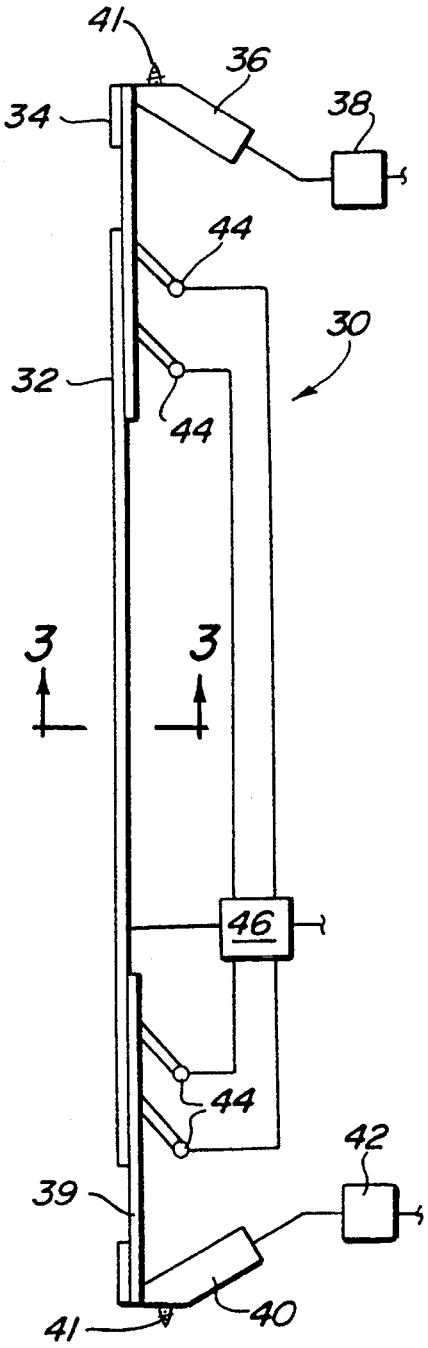
Fig-2
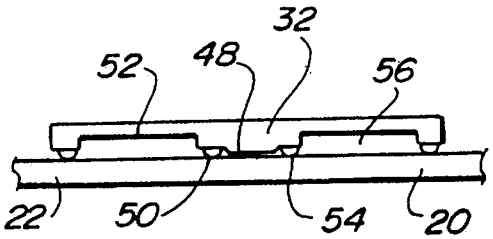
Fig-3
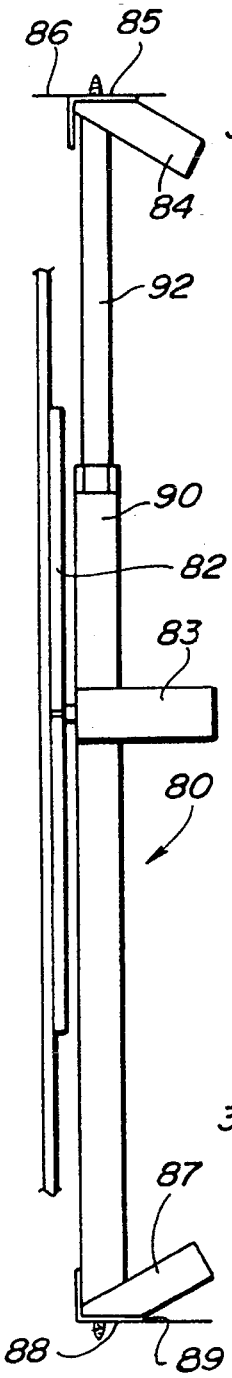
Fig-5
Fig-4
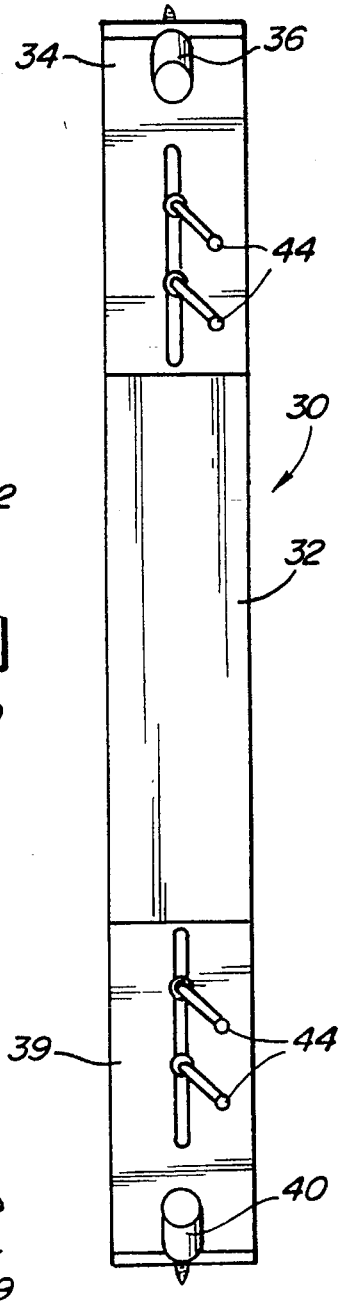

CLAMP FOR HOLDING WALL PANEL AGAINST ADHESIVE

BACKGROUND OF THE INVENTION

This application relates to an automatically actuated clamp for holding a wall panel against an adhesive, to allow the adhesive to cure and secure the wall panel to a structure.

Recently, foamable adhesives have been used to secure wall panels to walls in structures. As an example, many homes are now constructed by building wall frames including the wall stud members, then placing an adhesive on the frames. Wall panels are then held against the adhesive, and the adhesive cures securing the panel to the frame. This method is particularly well suited to the use of gypsum sheet rock, or panels typically known as drywall. The use of the adhesive does not create as much damage to the panel as occurs with nailing. Moreover, the panels are secured much more easily and quickly than with nailing.

Even so, with the use of the adhesive, some challenges arise in holding the panel against the studs while the adhesive cures. The prior art has typically used various types of bracing, however, the bracing itself will sometimes leave marks on the panel, thus defeating one of the main benefits of using the adhesive. Further, the use of the bracing is time consuming, and not always as effective as desirable.

The prior art has proposed a mechanically actuated brace member that is adjusted to hold the panel against the adhesive. That prior suggestion is somewhat deficient, however, since the device requires manual adjustment of the clamp members to secure the clamp, and then to hold the panel against the wall stud. The setup is thus too time consuming, and these braces would not be practical.

SUMMARY OF THE INVENTION

In one broad aspect of this invention, a clamp for holding a panel against an adhesive on a wall frame includes a holding member that receives a fluid force to hold the panel in a position where it is secured against the adhesive. In one aspect of this invention, the clamp includes two vacuum chambers that are positioned on two adjacent panels near an edge of the two panels. As has been previously explained in United States patent application No. 08/089,726, there are sometimes difficulties in properly aligning the edges of two adjacent panels. This has resulted in an undesirable appearance at the edge, and further requires patching and taping to reduce the discontinuity at the edge. In the above referenced application, panels being built for pre-constructed homes are placed on a vacuum table and the edges are brought into a position where they will be aligned.

The present invention discloses a clamp that is secured adjacent the edges of the two panels, and includes two vacuum chambers which draw edges of the panel against a flat surface. The flat surface insures that the edges are in abutting position as the adhesive cures to secure the panel. The vacuum chambers do not draw the panel for such an amount that the panel moves away from the adhesive. In that sense, the clamp "holds" the panel at a position where it is against the adhesive, insuring that the panel will be properly secured to the structure as the adhesive cures.

In other embodiments of this invention, several clamps are disclosed which include pusher members that receive a hydraulic or pneumatic force to force a surface against the panel. The surfaces hold the panel against the adhesive. These clamps also preferably include some structure for securing the clamp to the structure adjacent the panel. In one embodiment, angled cylinders are utilized adjacent the top and bottom of the clamp. Those cylinders carry screws that are driven into surfaces to hold the clamp. In another embodiment of this invention, the securement structure is a suction cup fixed to the clamp for holding the clamp to the wall panel. In this embodiment, the pusher member also pushes against the wall panel. The suction cup ensures that the clamp stays in position adjacent the panel while the pusher member insures that the panel is held against the adhesive. It should be understood that there is some tolerance in the exact position of the panel against the adhesive. Thus, the fact that the suction cup may tend to pull the panel slightly away from the wall at the same time the pusher member is pushing the panel against the wall still results in a panel that is properly secured to the wall.

In another embodiment of this invention, the structure for securing the clamp adjacent the panel includes a pair of foot members at top and bottom locations of an elongated clamp member. Those foot members are actuated by a cylinder to expand and hold the clamp against the ceiling and the floor. The pusher member is then actuated to hold the panel against the wall frame.

In a method according to this invention, a wall panel is secured to a structure by placing adhesive around the frame that is to hold the wall panel. The wall panel is then placed on the frame. A clamp is then actuated to provide a fluid force holding the panel in a location where it is in contact with the adhesive as the adhesive cures. In one embodiment, this method includes applying a vacuum on the panel to pull the panel to a desired location. In the other embodiments, the fluid actuation actuates a pusher member which holds the panel in the desired location.

With either embodiment, appropriate fluid controls are required to insure that the sequence of operation of the securement structure and the pusher members is as desired. Most preferably, the clamp includes fluid control structure that ensures the clamp is initially secured to the structure or the panel, and the pusher member or vacuum chamber is then actuated to hold the panel at the desired location.

These and other features of the present invention will be best understood from the following specification and drawings, of which the following is a brief description.

BRIEF DESCRIPTION OF THE DRAWINGS

FIG. 2 is a partially schematic view of a first embodiment clamp.

FIG. 3 is a cross-sectional view showing the embodiment of FIG. 2.

FIG. 4 shows the rear of the clamp shown in FIG. 2.

FIG. 5 is a partially schematic view of a second embodiment clamp.

DETAILED DESCRIPTION OF A PREFERRED EMBODIMENT

Figure 1:
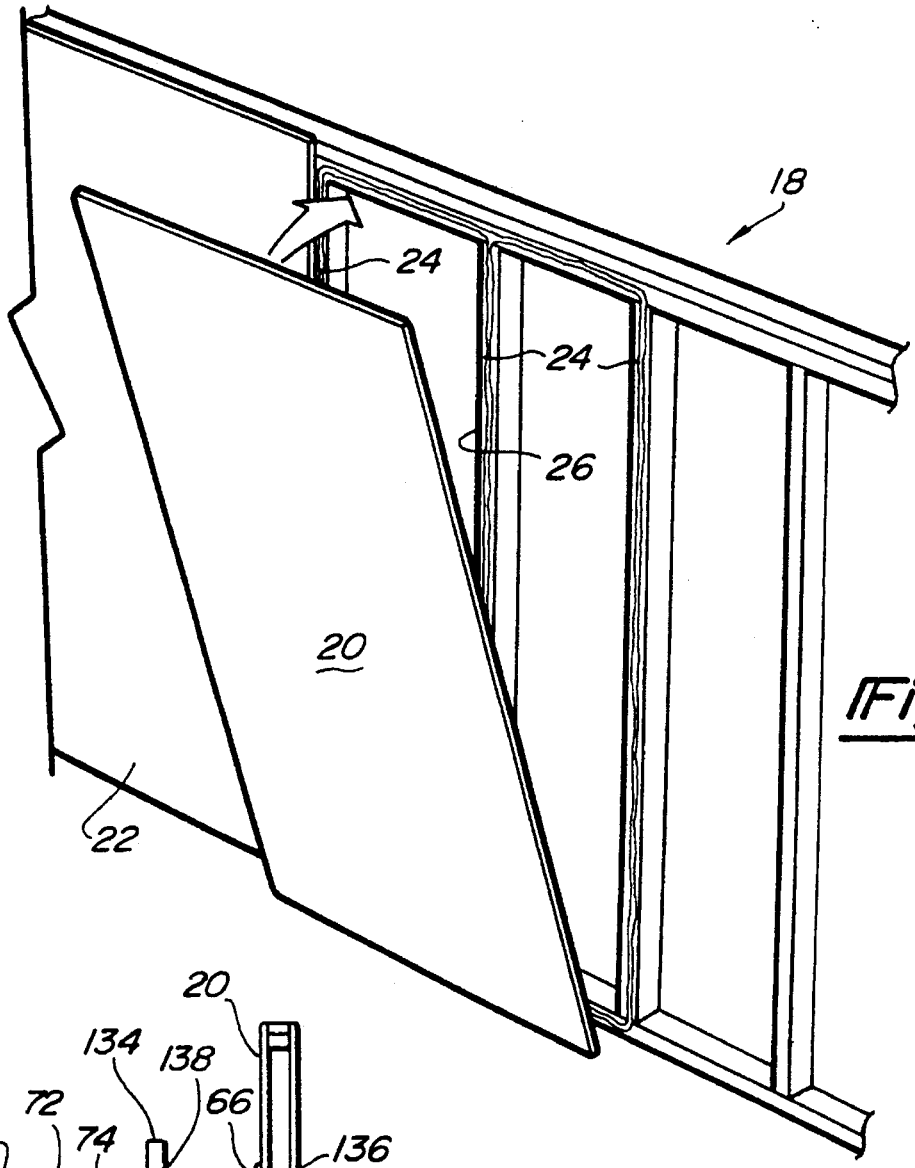
FIG. 1 shows a structure receiving a wall panel.

FIG. 1 shows a wall frame 18 receiving a wall formed of a series of wall panels 20 and 22. As is known, an adhesive bead 24 is placed along the wall studs 26 that are to receive the panels 20 and 22. As discussed above, the use of the adhesive to secure the wall panels provide several valuable benefits. This invention provides an efficient automatic means of holding the panel against the adhesive 24 as the adhesive cures.

The present invention could be broadly described as using a fluid force to hold the panel at a desired location as the adhesive cures. In one aspect, the fluid may be air drawn away to create a vacuum, thus drawing the panels to a desired location. In other embodiments of this invention, the fluid may be used to push a pusher member to hold the panel at a desired location.

FIG. 2 shows a first embodiment clamp 30. Clamp 30 includes a clamping portion 32 at the vertical center of the clamp 30. Clamping portion 32 is placed about the abutting edges of panels 20 and 22. An upper securement portion 34 includes an angled motor 36 which receives a control signal 38. Similarly, a bottom securement portion 39 receives angled motor 40 which is also connected to a control 42. Motors 36 and 40 may drive a screw 41 into the floor and ceiling to secure clamp 30. Vacuum connections are made between central portion 32 and a source of a vacuum 46 and also to appropriate fluid controls. Locking handles 44 allow adjustment of the relative position of the upper and bottom portion relative to the central portion.

As shown in FIG. 3, central portion 32 is preferably positioned about the abutting edges of the panels 20 and 22. The panels 20 and 22 are typically drywall, and are often low cost items. Their edges are often warped or out of alignment from each other. Thus, in the past there have been problems in obtaining a smooth edge at the abutting edges 20 and 22. The present invention creates a vacuum to draw the panels 20 and 22 against a reference surface 48 to provide a smooth abutting edge. This reduces, or eliminates, subsequent taping to result in a smooth edge of panels 20 and 22.

As shown, the central portion 32 includes a reference abutting surface 48 which is placed over the actual edges. A gasket 50 is formed adjacent one of the panels, here 22, and a gasket 50 surrounds a vacuum chamber 52 that is placed about one of the panels, here 22. Although it cannot be seen from this figure, it should be understood that the vacuum chamber 22 will be defined by the perimeter of gasket 50. Similarly, gasket 54 defines a vacuum chamber 56, here shown on panel 20. When clamp 30 is in use, it is placed about the edges of adjacent panels 20 and 22. The motors 36 and 40 are actuated to hold the clamp 30 against the ceiling and floor of the structure. The vacuum source 46 is then actuated and a vacuum is drawn in chambers 52 and 56. The fluid force of the vacuum draws panels 22 and 20 slightly away from wall studs 26, with the edges of the panels 20 and 22 drawn against the reference surface 48. Thus, smooth abutting edges are achieved by holding the edges of both panels against the reference surface 48. It should be understood that the panels 22 and 20 are only drawn slightly away from the wail studs 26, but they are still held at a location which is within a range of tolerance still holding the panels 20 and 22 against the adhesive bead 24. Thus, not only are the edges held in a desired location to provide a smooth joint between the panels 20 and 22, but at the same time, the panels 20 and 22 are still held against the adhesive as the adhesive cures.

As shown in FIG. 4, locking handles 45 at the rear of clamp 30 allow the upper securement portion 40 and bottom securement portion 39 to be moved relative to adjust the total height of clamp 30. The locking handles are shown schematically, and any known guiding and locking structure may be used to adjust the height of clamp 30.

In a method according to this invention, clamp 30 is positioned adjacent a pair of wall panels 20 and 22. The securement structure, here motors 36 and 40, is actuated to hold the clamp 30 against the structure. A vacuum is then drawn in the chambers 52 and 56, drawing the panels 22 and 20 at their edges against the reference surface 48. The clamp is then held in this position, holding the panels 22 and 20 against the adhesive as the adhesive cures.

Another embodiment clamp 80 is shown in FIG. 5. Clamp 80 includes a pusher member 82 driven by a fluid cylinder 83. An upper motor 84 drives a securement member into the ceiling 86. Similarly, a lower securement motor 87 drives another securement member into a floor 89. The length of the clamp member 80 may be adjusted by the telescoping structure 90 and 92, which may be driven by a fluid cylinder. Appropriate controls for the cylinders and motors are well within the skill of a worker in t he art.

Figure 6:
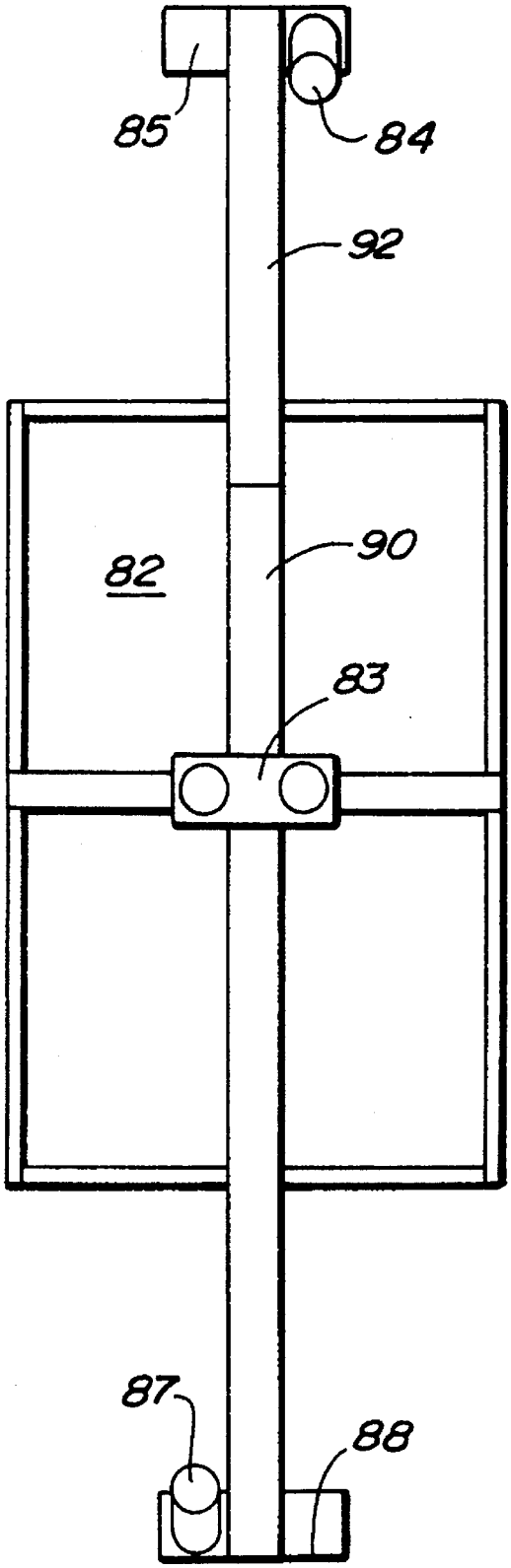
FIG. 6 is a rear view of the clamp shown in FIG. 5.

FIG. 6 is a rear view of the clamp 80. The securement structure motors 84 and 87 are initially actuated to secure the clamp 80 to the structure. Cylinder 83 is then actuated to drive the pusher portion 84 against the panel 20.

Figure 7:
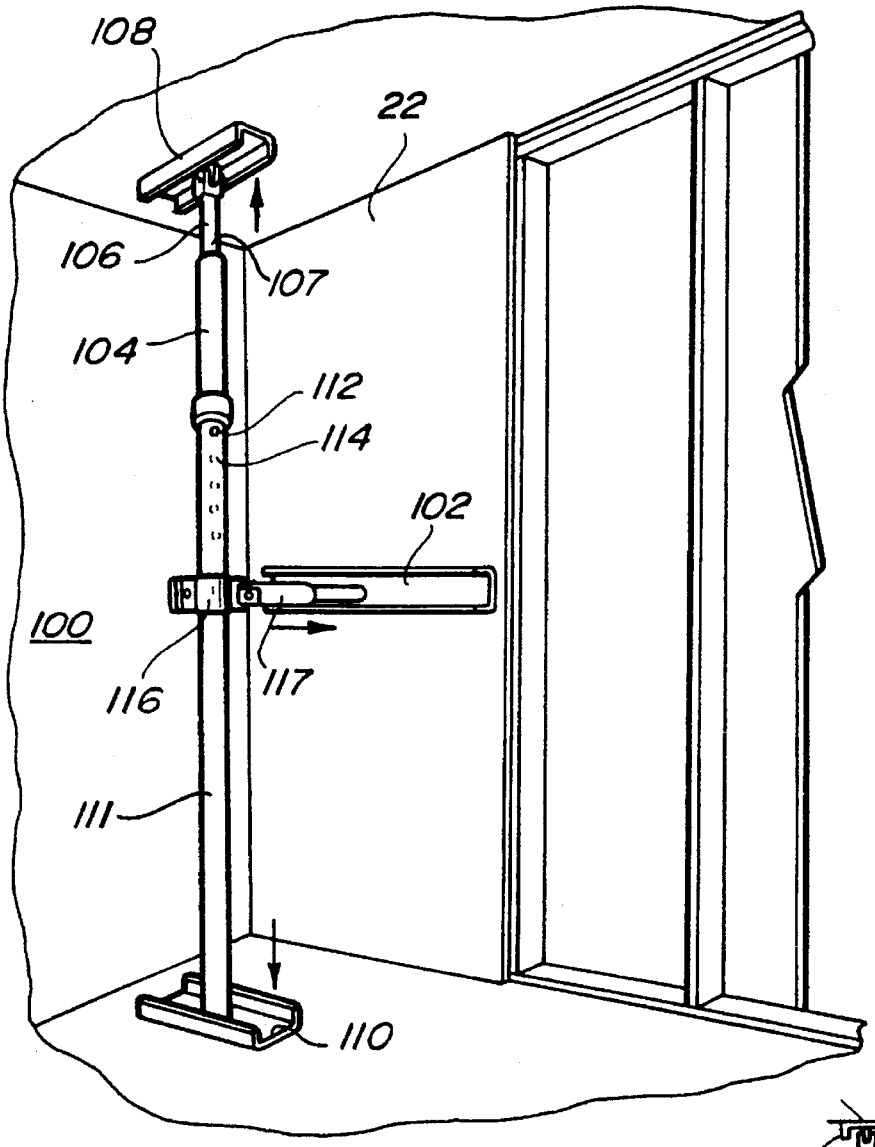
FIG. 7 shows yet another embodiment clamp.

Another embodiment clamp 100 is shown in FIG. 7. Clamp 100 includes a pusher portion 102 holding the panel 22 against the wall frame. A body of clamp 100 is formed by a upper telescopic member 104 which receives a fluid cylinder 106. Cylinder 106 has its piston 107 connected to drive a foot 108 against the ceiling. As foot 108 is driven against the ceiling, a force is applied to a lower foot 110, associated with a lower telescopic member 111. Feet 108 and 110 may receive a corrugated rubber surface to prevent marring of the ceiling and floor surfaces.

A series of holes 114 are formed in lower telescopic member 111. These holes 114 selectively receive a bolt 112 to secure the telescopic members 104 and 111 at a desired height. In that way, the cylinder 106 need not have an unduly large stroke. Rather, the distance between the telescoping members 104 and 111 can be adjusted to adjust to various ceiling heights for a particular structure. A clamp 116 secures the pusher member 102 and its cylinder 117 to the lower telescopic member 111.

Figure 8:
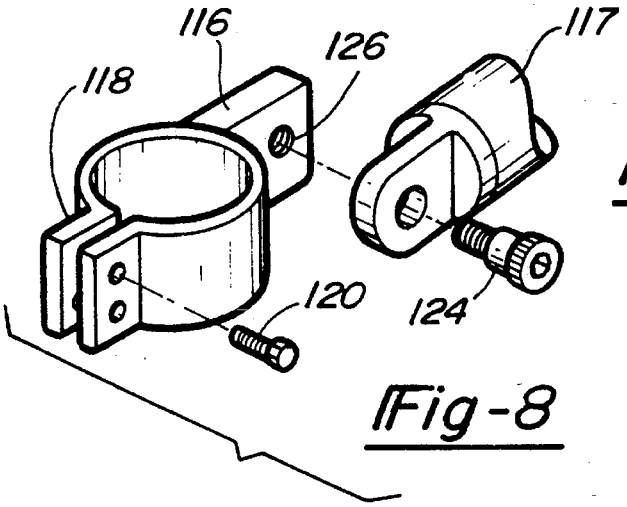
FIG. 8 shows one detail of the clamp shown in FIG. 7.

As shown in FIG. 8, clamp 116 includes a rear split clamp portion 118 receiving a pair of bolts 120 to secure the clamp 116 at a desired height on the lower telescopic portion 111. Similarly, the cylinder 117 is connected to a clamp 116 by a pivot connection between a bolt 124 extending into a threaded hole 126 in clamp 116. As shown, the portion of bolt 124 received in cylinder 117 connecting the cylinder to the clamp 116 is not threaded, thus allowing pivoting movement for adjustment of the pusher member 102 to the surface of the wall panel.

Figure 9:
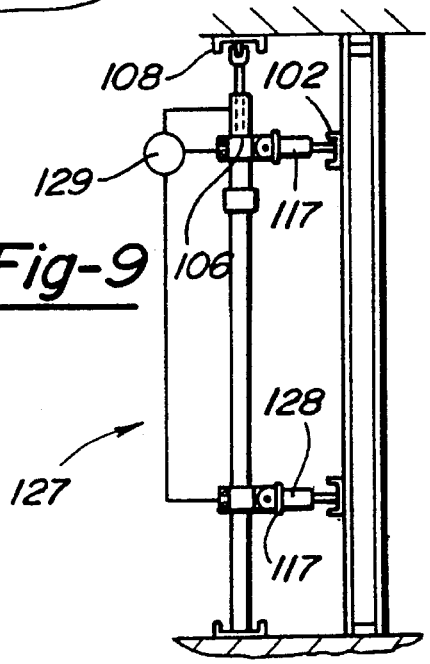
FIG. 9 shows another embodiment clamp.

As shown in FIG. 9, another embodiment clamp 127 is similar to that shown in FIG. 7, however a second pusher portion 128 is used at a lower location.

With the embodiments shown in FIGS. 7-9, a clamp is positioned adjacent a panel to be held. The upper cylinder 106 is actuated to drive the feet 108 and 110 to secure the clamp 100 or 127 to the structure. The pusher portions 102 and 128 are then be actuated to hold the panel against the wall frames.

With all of the embodiments of FIGS. 5-9, a flow control, shown schematically as 129 in FIG. 9 is utilized to control the sequence of operation between the securement structure and the pusher member. In FIG. 9, upper cylinder 106 is initially actuated, and the lower cylinders 117 are then actuated. In one embodiment, a restriction could be placed on the flow lines leading to cylinders 117, while no obstruction is placed on the lines leading to cylinder 106. In such a construction, the fluid will move first to the cylinder 106, which will be actuated to drive the feet against the ceiling and floor. Once the feet are fully actuated, there will then be restriction to further flow into cylinder 106. At that time, the fluid moves into the cylinder 117, driving the pusher members against the panel.

Figure 10:
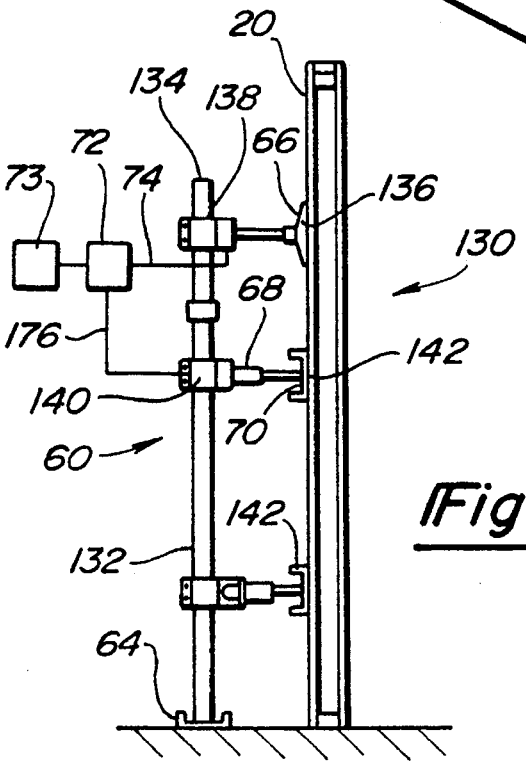
FIG. 10 shows yet another embodiment clamp.

FIG. 10 shows yet another embodiment clamp 130. In clamp 130, a frame 132 includes an upper telescopic portion 134. The clamp 130 is secured to the panel 20 by an upper suction cup 136. Suction cup 136 is held by a clamp 138 to the upper portion of frame 134. A source of vacuum 173 is connected to the suction cup 136. A lower cylinder 140 drives a pusher member 142 at a lower position 132 on the frame. It should be understood that cylinder 140 is connected to a source of fluid pressure and appropriate controls 172.

In a method of using the clamp embodiment 130, the clamp 130 is initially placed adjacent a panel 20 be held against a frame. The vacuum is initially applied to the suction cup 136, thus securing the clamp 130 adjacent the panel 20. Once the clamp 130 is secured adjacent the panel, fluid pressure is supplied to the cylinder 140 driving the pusher member 142 against the panel, to hold the panel in that location as the adhesive cures.

In general, with the embodiments of FIGS. 5–10, some means of securing the clamps is actuated, and a pusher member then holds the panel against the adhesive.

Preferably, the cylinders are Bimbas cylinders. In addition, various known fluid circuit control members would be incorporated into the several embodiments as would well be well within the scope of workers of ordinary skill in the art. The details of the fluid controls form no portions of this invention. Rather, it is the use of the inventive arrangements of the clamp members, and the inventive method of using the clamp members which is the inventive aspect of this application. In addition, any type of fluid power could be utilized; i.e., the cylinders could be either pneumatic or hydraulic.

In addition, for all embodiments, including those which utilize a rotating motor to drive a securement member into the structure, such as those that drive a threaded member into the floor and ceiling, it is also preferable that a control control both the securement members and the fluid actuation of either the source of vacuum or the source of fluid pressure. It is also preferred that the securement member be initially actuated automatically to secure the clamp member, and that the fluid force then be actuated to hold the panel at the desired position.

Several embodiments of this invention have been disclosed. A worker of ordinary skill in the art would recognize, however, that certain modifications would come within the scope of this invention. For that reason, the following claims should be studied to determine the true scope and content of this invention.

I claim:

1. A clamp holding a wall panel against an adhesive on a structure comprising:

a first surface to be placed in contact with a panel to be held;

a fluid control applying a fluid force to hold a panel against said first surface; and a securement structure to secure said clamp to a location adjacent the panel.

2. A clamp as recited in claim 1, wherein the fluid control is a source of vacuum, that draws the panel against said first surface.

3. A clamp as recited in claim 2, wherein said clamp is placed across abutting edges of two adjacent panels, said clamp including at least one vacuum chamber for drawing edges of the two panels against said first surface to result in smooth mating edges for the two adjacent panels.

4. A clamp as recited in claim 3, wherein there are two of said vacuum chambers, with one of said vacuum chambers being associated with each of the panels.

5. A clamp as recited in claim 4, wherein said first surface is positioned between said two vacuum chambers, and is adapted to be placed across the abutting edges of the adjacent panels.

6. A clamp as recited in claim 5, wherein a gasket surrounds each of said two vacuum chambers.

7. A clamp as recited in claim 1, wherein said fluid control supplies a pressurized fluid to move a pusher member carrying said first surface into contact against the panel.

8. A clamp as recited in claim 7, wherein there are a pair of vertically spaced pusher members.

9. A clamp as recited in claim 7, wherein said securement structure includes a suction cup positioned in connect with the panel, said suction cup holding said clamp to the panel while said pusher member holding said panel against the adhesive as the adhesive cures.

10. A clamp as recited in claim 7, wherein said securement structure includes upper and lower securement members, said upper and lower securement members being driven automatically by fluid pressure to hold the clamp adjacent the panel.

11. A clamp as recited in claim 10, wherein said fluid control operates automatically to initially actuate said securement/structure and then actuate said pusher member.

12. A clamp as recited in claim 1, wherein said securement structure includes a pair of angled motors to drive threaded members into a floor and ceiling of the structure adjacent to the panel.

13. A clamp as recited in claim 1, wherein said clamp has a height which is adjustable to conform to a vertical dimension of the structure which is receiving the panel.

14. A clamp for holding a panel against an adhesive bead on a structure as the adhesive bead cures comprising:

(a) frame structure including a cylinder to receive a pressurized fluid, said cylinder driving a pusher member, said pusher member being adapted to hold a panel against the adhesive bead;

(b) securement structure for holding said clamp adjacent to the panel as said pusher member is driven by said cylinder;

(c) a control for automatically actuating said securement structure, and then actuating said pusher member.

15. A clamp as recited in claim 14 wherein said securement structure is fluid actuated, and said control provides fluid actuation to both the securement structure and said pusher member.

16. A clamp as recited in claim 14, wherein said securement structure is mechanically actuated.

17. A clamp holding a pair of adjacent wall panels against an adhesive on a structure comprising:

a first planar surface to be placed in contact across two adjacent edges of the panels;

a pair of vacuum chambers on each lateral side of said planar surface, said vacuum chambers being positioned such that they will overlie surfaces of adjacent panels having adjacent edges;

a securement structure securing the clamp adjacent to the panels, and a control selectively connecting said vacuum chambers to a source of vacuum to draw the panels away from a structure and against said planar surface, but still hold the edges of the panels in contact with an adhesive on said structure.

18. A clamp as recited in claim 17, wherein said control draws the edges of the two panels against said first surface to result in smooth mating edges for the two adjacent panels.

19. A clamp as recited in claim 17, wherein a gasket surrounds each of said two vacuum chambers.

20. A clamp as recited in claim 17, wherein said securement structure includes upper and lower securement members, said upper and lower securement members being driven automatically by fluid pressure to hold the clamp adjacent the panel.

21. A clamp as recited in claim 17, wherein said securement structure includes a pair of angled motors to drive threaded members into a floor and ceiling of the structure adjacent to the panel.

22. A clamp as recited in claim 21, wherein said securement structure is fluid actuated.

23. A clamp as recited in claim 21, wherein said securement structure is mechanically actuated.

24. A clamp as recited in claim 21, wherein a height of said clamp is adjustable to conform to a vertical dimension of the structure which is receiving the panel.

25. A clamp as recited in claim 17, wherein a height of said clamp is adjustable to conform to a vertical dimension of the structure which is receiving the panel.

* * * * *

UNITED STATES PATENT AND TRADEMARK OFFICE

CERTIFICATE OF CORRECTION

PATENT NO. : 5,617,698

DATED : April 8, 1997

INVENTOR(S) : Bruce T. Guilmette, Ortonville, Mich.

It is certified that error appears in the above-indentified patent and that said Letters Patent is hereby corrected as shown below:

The Inventor field on the title page of the Patent should be corrected as follows:

[75] Inventor(s): Bruce T. Guilmette, Ortonville, Mich.;
N. Keith Merser, Northbranch, Mich.

Item [19], --,et al.--.

Signed and Sealed this

Fifth Day of August, 1997

Bruce Lehman

*Attest:*

BRUCE LEHMAN

*Attesting Officer*

*Commissioner of Patents and Trademarks*